United States Patent [19]

Wikdahl

[11] Patent Number: 4,504,016

[45] Date of Patent: Mar. 12, 1985

[54] PROCESS FOR CLEANING CHEMICAL CELLULOSE PULP BY SCREENING AND APPARATUS

[76] Inventor: Nils A. L. Wikdahl, Bravallavagen 42, S-182 64 Djursholm, Sweden

[21] Appl. No.: 510,469

[22] Filed: Jul. 1, 1983

[51] Int. Cl.[3] ..... B02C 23/08; B03B 7/00; D21H 5/00

[52] U.S. Cl. ..... 241/24; 241/28; 209/17; 162/55

[58] Field of Search ..... 162/24, 28, 55; 209/2, 209/3, 10, 17, 234, 235, 144, 211, 313–315; 241/24, 28, 80, 46.17

[56] References Cited

U.S. PATENT DOCUMENTS

| | | | |
|---|---|---|---|
| 3,301,745 | 1/1967 | Coppick et al. | 162/55 |
| 3,411,720 | 11/1968 | Jones et al. | 241/28 |
| 3,791,917 | 2/1974 | Bolton | 162/55 |

*Primary Examiner*—Charles Hart

[57] ABSTRACT

Process and apparatus are provided for cleaning chemical pulp by screening, in which the rejects from a first screening stage are rescreened in a second screening stage; the accepts from the second screening stage are separated in a hydrocyclone, and the clean fraction recycled to the first screening stage; the rejects from the second screening stage are beaten in a refiner and screened before or after the refiner; the suspension from the refiner is taken to the screen before the refiner, and the rejects from the screen after the refiner are recycled to the refiner.

19 Claims, 2 Drawing Figures

PROCESS FOR CLEANING CHEMICAL CELLULOSE PULP BY SCREENING AND APPARATUS

Figure 1:
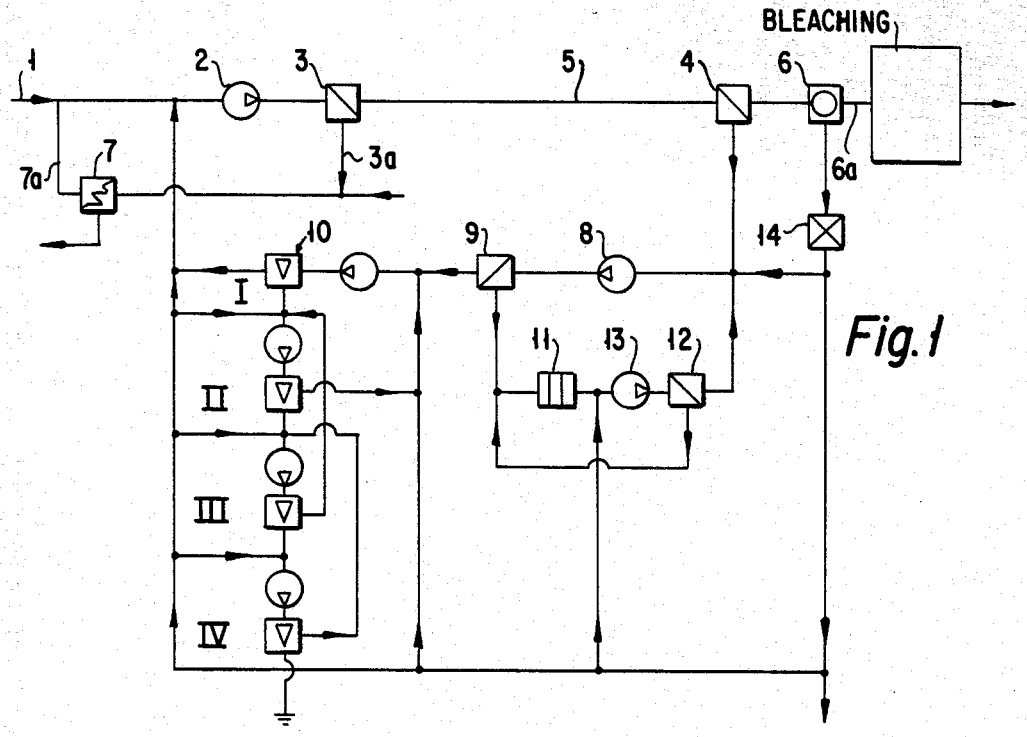

In the production of chemical pulp one naturally wishes to obtain as high a yield as possible at the lowest possible cost, at the same time not allowing the quality to fall below specified requirements. Operating costs and yield play a large part in minimizing costs.

The present invention makes it possible to increase the yield of chemical pulp by refining screen rejects in a refiner which defibrates shives to fibres without the prime fibres in the rejects being cut off or damaged significantly, and by rescreening the screen rejects processed in the refiner.

The invention accordingly provides a process of cleaning a chemical cellulose pulp suspension, which comprises screening the chemical pulp in a first fine screening stage; leading the accepts to further processing and rescreening the rejects in a second fine screening stage; leading the accepts to at least one hydrocyclone stage; and recycling at least part of the accepts from the hydrocyclone stage to the first screening stage; refining at least part of the rejects from the second screening stage; and combining at least part of the refined rejects with the rejects from at least one of the first screening stage and the second screening stage.

Thus, in accordance with the invention, a chemical pulp suspension of the type that is usually washed and freed from knots and other coarse contaminants by passage through a coarse screen (knotter) is instead screened in a first fine screen. This screen has an opening size (round holes or slits) such that for a selected reject number or rate, i.e. quotient of rejected flow and incoming flow, the accepted suspension meets the specified requirements for purity. The rejects from the first fine screen, although containing a major part of the contaminants, such as pieces of bark and shives which have passed through the coarse screen, also contain a large quantity of prime fibres, which must be recovered and brought into the main flow. These rejects are therefore rescreened in a second fine screen that divides the incoming flow into an accepts flow that is processed in one or more hydrocyclone stages, and a rejects flow containing the major portion of shives. The accepts flow obtained from the hydrocyclone stage or stages, containing substantially only prime fibres and shives, is recycled to the first fine screen, optionally via an intermediate coarse screen. The rejects flow from the last hydrocyclone stage is discarded.

Accordingly, for carrying out this process, the invention also provides apparatus for cleaning chemical cellulose pulp suspensions, which comprises, in combination, in fluid flow connection, a first fine screen for screening the chemical pulp in a first screening stage, leading the accepts to further processing; a second fine screen for rescreening the rejects from the first cleaning stage in a second screening stage; at least one hydrocyclone for cleaning the accepts from the first cleaning stage in a first hydrocyclone stage; means for recycling at least part of the accepts from the hydrocyclone stage to the first fine screen; a refiner for refining at least part of the rejects from the second screening stage; and means for combining at least part of the refined rejects with the rejects from at least one of the first screening stage and the second screening stage, and recycling these combined rejects to the first screening stage.

In a preferred embodiment, the apparatus comprises a third screen for rescreening the rejects from the second screening stage and a second refiner for refining the rejects from the third screening stage and combining the refined rejects with the rejects from at least one of the second screening stage and the first screening stage, before recycling to the first screening stage.

What distinguishes the invention is that at least a part of the rejects from the second fine screen is processed in a refining stage using a refiner, and the resulting suspension is then combined, at least in part, with rejects from the first and/or second fine screen. This processing in the refiner takes place at a low pulp concentration, which is suitably that of the rejects obtained from the second fine screen. Refining may be carried out at a high pulp concentration, however, the suspension (rejects) then being thickened in a thickener before the refiner.

In accordance with a preferred embodiment, the entire rejects flow from the second fine screen is supplied to the refiner, and the resulting suspension is passed through a third fine screen, the rejects of which at least in part is recycled to the refiner, and the accepts of which is at least partially rescreened in the second fine screen.

In accordance with another embodiment, the rejects from the second fine screen are rescreened in a third fine screen. The accepts from this screen are combined with the rejects from the first fine screen. The rejects are processed in the refiner, and subsequently combined with the rejects from the second and/or first screen, preferably from the second screen. Processing in the refiner suitably takes place at the pulp concentration of the rejects obtained from the third fine screen, but can also be carried out at higher pulp concentrations, the rejects from the third screen being thickened in a thickening or dewatering apparatus before it is supplied to the refiner. A smaller refiner can be used in this embodiment than in the embodiments previously described.

The term "chemical pulp" as used herein refers to a pulp processed by a pulping process that includes at least one or several or all chemical pulping stages, including, for example, one or more mechanical, thermomechanical and/or semichemical pulping stages. The term thus encompasses chemical pulp, semichemical pulp, chemimechanical pulp, and chemithermomechanical pulp.

The term "fine screen" means a screen having openings whose largest dimension is within the range from about 0.5 to about 2 mm or slits whose width is within the range from about 0.5 to about 1 mm.

Figure 2:
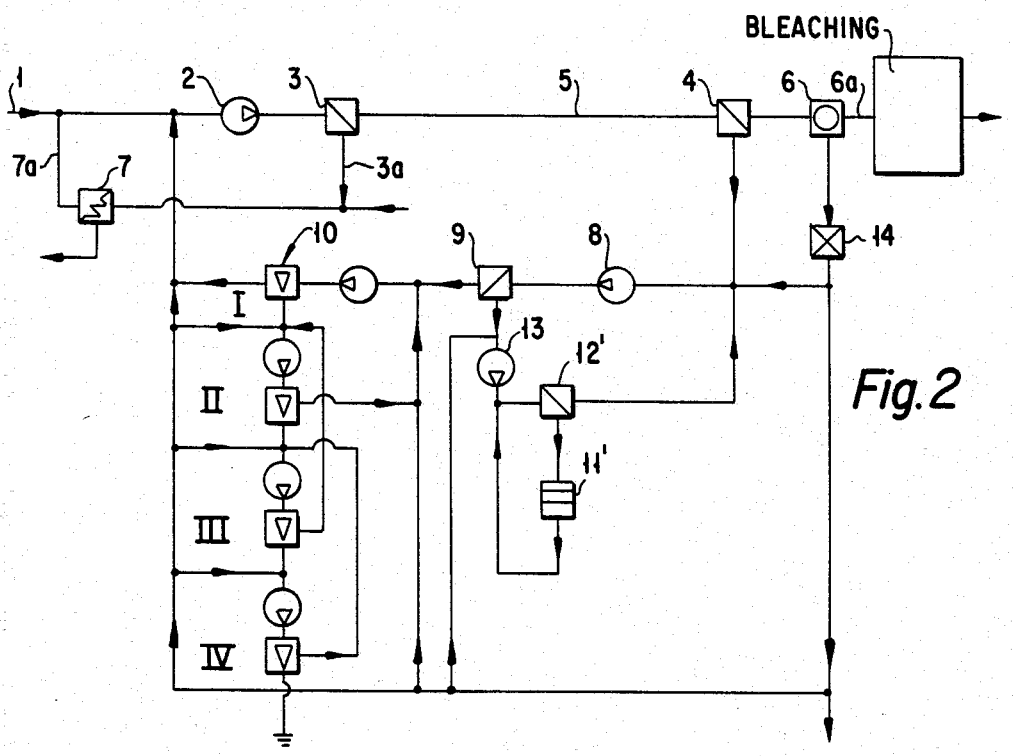

In the drawings:

FIG. 1 illustrates a screening system for unbleached chemical pulp, where the rejects from the second screen are processed in a refiner; and FIG. 2 illustrates a screening system for unbleached chemical pulp similar to the one in FIG. 1, but in which the third screen rejects are processed in a refiner.

In the screening system according to FIG. 1, a chemical pulp suspension, preferably washed, enters via line 1 and before pump 2 is diluted to a suitable pulp concentration for screening. The pump 2 pumps the suspension to a coarse screen (knotter) 3 for removing knots and other coarse contaminants. The screen 3 is suitably a pressurized screen, i.e. with round screen openings 6 to 12 mm in diameter. The rejects from screen 3 contain prime fibres and coarse contaminants and are led via 3*a* to a screen 7, which may either be pressurized or open, and rescreened. The accepts from screen 7, freed from knots and other coarse contaminants, are recycled via a line to line 1 in front of pump 2, and the rejects from the screen 7 are led out from the system.

The accepts from the coarse screen 3 freed from coarse contaminants are screened in a first fine screen 4, which is a pressurized screen. This screen 4 is adapted for working with a rejects quotient such that the accepts fraction is sufficiently clean for its intended purpose. By "rejects quotient" is meant here the relationship between the quantity by weight of rejected solid substance and incoming solid substance per time unit. The accepts fraction from the screen 4 is thickened in a dewatering or thickening apparatus 6, and taken from there via line 6a to a bleaching plant. After bleaching, the pulp is diluted, rescreened, and taken through a hydrocyclone plant.

The primary fine screen 4 works with a rejects quotient such as 25 to 35%, and its rejects contain a large quantity of prime fibres, together with shives and other contaminants such as pieces of bark. It is therefore rescreened in a second, preferably pressurized, fine screen 9, the screen of which can have somewhat larger openings than those of the primary screen 4. The second screen suitably works with a reject quotient of 30 to 50%. The accepts suspension from this screen is separated conventionally in hydrocyclones 10. These may be "cascade" connected, and in FIG. 1 four stages I, II, III, IV are shown. The accepts suspensions from the hydrocyclones are combined and recycled via line 10a to the line 1 in front of the pump 2, while the rejects which are enriched with contaminants, e.g. bark, are led out of the system.

The rejects from the second fine screen 9 go to a rejects refiner 11, working at a low pulp concentration, in which shives are defibrated to fibres. A refiner working at a high pulp concentration can be used instead of the refiner 11. In this case, the rejects from the screen 9 must be thickened, e.g. in a press, before being supplied to the apparatus. The fibre suspension from the refiner 11 is taken via a pump 13 to a third fine screen 12. If refining is done at a high pulp concentration, there must be a dilution before screening in the third screen 12. The incoming fraction, which has been processed in the refiner, is screened and divided into accepts and rejects fractions in the third screen 12. This screen may have a rejects quotient of 20 to 40%, and its screen may have the same size of openings as the screen in the secondary screen 9. The rejects from screen 12 are recycled to the refiner 11, or the thickening apparatus coming before the refiner, if refining is done at high pulp concentration. The accepts from the screen 12 are combined with the rejects from the primary screen 4 in front of the pump 8, and the combination is rescreened in the second screen 9.

The screening members in all the fine screens can be provided with round holes or slits. For example, the primary screen 4 may have round holes with a diameter of 1.4 mm, for screening hardwood pulp, and with a diameter of 1.6 mm, for screening softwood pulp. The screening member in the secondary and tertiary screens 9 and 12, respectively, may be provided with larger holes, such as 1.8 mm in diameter.

The substantially fibre-free fraction from the thickening apparatus 6 is collected in a vessel 14, functioning as a level-maintenance vessel with a constant level. To ensure that all pumps in the system operate at the same reference pressure, they are connected on the suction side to the vessel 14, as described in the Swedish Pat. No. 224,271.

The system according to FIG. 2 is similar to the one in FIG. 1, except that the rejects from the secondary screen 9 are screened once more before being processed in the refiner 11. The rejects from this screen 9 are taken to a tertiary fine screen 12'. The accepts from the screen 12' are combined with the rejects from the screen 4 in front of the pump 8, and rescreened in screen 9. The rejects from screen 12' are processed in a refiner 11', and rescreened in screen 12'. The result of this method is that a smaller refiner 11' can be used than in the system according to FIG. 1, with the advantage that the fibres are less likely to be damaged during refining.

Having regard to the foregoing disclosure, the following is claimed as the inventive and patentable embodiments thereof:

1. A process of cleaning a chemical cellulose pulp suspension, which comprises screening the chemical pulp in a first fine screening stage; leading the accepts to further processing and rescreening the rejects in a second fine screening stage; leading the accepts from the rescreened rejects to at least one hydrocyclone stage; and recycling at least part of the accepts from the hydrocyclone stage to the first screening stage; refining at least part of the rejects from the second screening stage; and combining at least part of the refined rejects with the rejects from at least one of the first screening stage and the second screening stage.

2. A process according to claim 1, in which the chemical pulp in the suspension is unbleached.

3. A process according to claim 1 in which the rejects from the second screening stage are rescreened in a third screening stage, and the rejects from the third screening stage are refined in a refining stage and combined with the rejects from at least one of the second screening stage and the first screening stage.

4. A process according to claim 3, in which the accepts from the third screening stage are combined with the rejects from the first screening stage.

5. A process according to claim 1 in which the suspension obtained from the refining stage is screened in a third screening stage.

6. A process according to claim 5, in which the rejects from the third screening stage are at least in part recycled to the refining stage.

7. A process according to claim 5 in which the accepts from the third screening stage at least in part is combined with the rejects from the first screening stage.

8. A process according to claim 1, in which the fibre suspension supplied to the first screening stage is screened in a coarse screen or knotter, and the accepts from the coarse screening stage is supplied to the first screening stage.

9. A process according to claim 8, in which the rejects from the coarse screen are cleaned in a screen, the accepts of which are recycled to the coarse screen.

10. A process according to claim 1, in which the hydrocyclone stage comprises "cascade"-coupled hydrocyclones, and the rejects from the last hydrocyclone in the cascade are removed from the system.

11. Apparatus for cleaning chemical cellulose pulp suspensions, which comprises, in combination, in fluid flow connection, a first fine screen for screening the chemical pulp in a first screening stage, leading the accepts to further processing; a second fine screen for rescreening the rejects from the first cleaning stage in a second screening stage; at least one hydrocyclone for cleaning the accepts from the first cleaning stage in a first hydrocyclone stage; means for recycling at least part of the accepts from the hydrocyclone stage to the first fine screen; a refiner for refining at least part of the rejects from the second screening stage; and means for combining at least part of the refined rejects with the rejects from at least one of the first screening stage and the second screening stage, and recycling these combined rejects to the first screening stage.

12. Apparatus according to claim 11 which comprises a third screen for rescreening the rejects from the second screening stage and a second refiner for refining the rejects from the third screening stage and combining the refined rejects with the rejects from at least one of the second screening stage and the first screening stage, before recycling to the first screening stage.

13. Apparatus according to claim 12 comprising means for combining the accepts from the third screening stage with the rejects from the first screening stage.

14. Apparatus according to claim 11 comprising a third screen for screening the suspension obtained as accepts from the refining stage.

15. Apparatus according to claim 14 comprising means for recycling at least in part the rejects from the third screening stage to the refining stage.

16. Apparatus according to claim 14 comprising means for combining at least in part the accepts from the third screening stage with the rejects from the first screening stage.

17. Apparatus according to claim 11 comprising a coarse screen or knotter in which the fibre suspension supplied to the first screening stage is screened, and means for recycling to the first screening stage the accepts from the coarse screen or knotter.

18. Apparatus according to claim 17 comprising a third screen for screening the rejects from the coarse screen or knotter, and means for recycling to the third screen the accepts from the coarse screen or knotter.

19. Apparatus according to claim 11 in which the hydrocyclone stage comprises "cascade"-coupled hydrocyclones; and means for removing from the system the rejects from the last hydrocyclone in the cascade.

* * * * *